US005678158A

United States Patent [19]

Kurotori et al.

[11] Patent Number: 5,678,158

[45] Date of Patent: Oct. 14, 1997

[54] APPARATUS FOR REPETITIVELY USING A TONER IMAGE CARRIER

[75] Inventors: Tsuneo Kurotori, Tokyo; Katsuhiro Echigo, Asaka; Hisamitsu Mizuno, Tokyo; Mitsuaki Urakawa; Kunio Hibi, both of Yokohama, all of Japan

[73] Assignee: Ricoh Company, Ltd., Tokyo, Japan

[21] Appl. No.: 351,555

[22] Filed: Dec. 7, 1994

Related U.S. Application Data

[62] Division of Ser. No. 118,117, Sep. 7, 1993, abandoned.

[30] Foreign Application Priority Data

Sep. 7, 1992 [JP] Japan ..... 4-265433
Aug. 6, 1993 [JP] Japan ..... 5-214918

[51] Int. Cl.[6] ..... G03G 21/00

[52] U.S. Cl. ..... 399/390; 15/77; 15/102; 134/64 R; 134/122 R; 162/4

[58] Field of Search ..... 355/202, 297; 118/70; 156/281; 162/4, 265; 15/102, 77; 134/122 R, 122 P, 64 R, 64 P; 399/390

[56] References Cited

U.S. PATENT DOCUMENTS

| | | |
|---|---|---|
| 207,626 | 9/1878 | Sargent . |
| 722,252 | 3/1903 | Richards . |
| T892,011 | 11/1971 | York et al. . |
| T896,011 | 3/1972 | Gustafson et al. . |
| 1,947,748 | 2/1934 | Van Wormer . |
| 2,207,966 | 7/1940 | Billings . |
| 2,831,409 | 4/1958 | Bixley et al. . |
| 2,937,390 | 5/1960 | Bolton et al. . |
| 3,108,895 | 10/1963 | Howell . |
| 3,202,532 | 8/1965 | Labombarde . |
| 3,237,231 | 3/1966 | Zink . |
| 3,328,821 | 7/1967 | LaMura . |
| 3,448,720 | 6/1969 | Graham . |
| 3,598,487 | 8/1971 | Mizuguchi et al. . |
| 3,613,701 | 10/1971 | Ando . |
| 3,630,776 | 12/1971 | Barr . |
| 3,656,948 | 4/1972 | Mammino . |
| 3,776,631 | 12/1973 | Mammino . |

(List continued on next page.)

FOREIGN PATENT DOCUMENTS

| | | |
|---|---|---|
| 50-56942 | 5/1975 | Japan . |
| 51-100728 | 9/1976 | Japan . |
| 54-27435 | 3/1979 | Japan . |
| 54-99353 | 6/1979 | Japan . |
| 57-114171 | 7/1982 | Japan . |
| 57-125962 | 8/1982 | Japan . |
| 57-125963 | 8/1982 | Japan . |
| 58-105569 | 7/1983 | Japan . |
| 59-2069 | 1/1984 | Japan . |
| 59-33483 | 2/1984 | Japan . |

(List continued on next page.)

OTHER PUBLICATIONS

Encyclopedia of Chemical Technology, 3rd Ed., vol. 6, 1979, pp. 386–426.

*Primary Examiner*—Nestor R. Ramirez
*Attorney, Agent, or Firm*—Cooper & Dunham LLP

[57] ABSTRACT

An apparatus for removing images on an image carrier sheet to allow the image carrier sheet to be repeatedly used. The apparatus includes an image removing member for removing images from an image carrier sheet, the images being fixed on the image carrier sheet. A liquid supply supplies a liquid to the image removing member and a transporting mechanism transports the image carrier sheet with the fixed images to the image removing member. The fixed images on the image carrier sheet are removed by the image removing member when the liquid supplied to the image removing member is applied to a surface of the image carrier sheet. A pressing member presses the surface of the image carrier sheet against the image removing member, the image removing member including a squeeze roller. The liquid supply means includes a liquid supply roller and the transporting mechanism comprises a pair of transport rollers. The squeeze roller is rotated at a higher speed than the pair of transport rollers.

3 Claims, 3 Drawing Sheets

U.S. PATENT DOCUMENTS

| | | | |
|---|---|---|---|
| 4,204,865 | 5/1980 | Kuehnle et al. . | |
| 4,249,653 | 2/1981 | Kufferath-Kassner . | |
| 4,252,882 | 2/1981 | Herrmann . | |
| 4,273,438 | 6/1981 | Nishikawa . | |
| 4,392,742 | 7/1983 | Landa . | |
| 4,482,241 | 11/1984 | Moraw et al. . | |
| 4,504,995 | 3/1985 | Zippwald . | |
| 4,733,422 | 3/1988 | Schramm et al. . | |
| 4,740,075 | 4/1988 | Schoernig . | |
| 4,800,839 | 1/1989 | Ariyama et al. . | |
| 4,899,872 | 2/1990 | Hokao . | |
| 4,905,047 | 2/1990 | Ariyama . | |
| 4,965,640 | 10/1990 | Watarai et al. . | |
| 5,063,411 | 11/1991 | Haneda et al. . | |
| 5,215,852 | 6/1993 | Kato et al. . | |
| 5,262,295 | 11/1993 | Chou et al. . | |
| 5,353,108 | 10/1994 | Tsukamoto . | |
| 5,359,398 | 10/1994 | Echigo et al. . | |
| 5,400,123 | 3/1995 | Sato et al. | 15/77 X |
| 5,463,447 | 10/1995 | Kurotori et al. | 355/202 |
| 5,474,617 | 12/1995 | Saito et al. | 15/102 X |

FOREIGN PATENT DOCUMENTS

| | | |
|---|---|---|
| 59-89372 | 5/1984 | Japan . |
| 59-93764 | 5/1984 | Japan . |
| 59-98172 | 6/1984 | Japan . |
| 60-133458 | 7/1985 | Japan . |
| 60-230899 | 11/1985 | Japan . |
| 62-102270 | 5/1987 | Japan . |
| 62-203190 | 9/1987 | Japan . |
| 62-212187 | 9/1987 | Japan . |
| 62-199767 | 12/1987 | Japan . |
| 63-73282 | 4/1988 | Japan . |
| 63-140577 | 9/1988 | Japan . |
| 1-101576 | 4/1989 | Japan . |
| 1-101577 | 4/1989 | Japan . |
| 1-137266 | 5/1989 | Japan . |
| 1-297294 | 11/1989 | Japan . |
| 2-11400 | 1/1990 | Japan . |
| 2-3400 | 1/1990 | Japan . |
| 2-55195 | 2/1990 | Japan . |
| 2-62277 | 3/1990 | Japan . |
| 2-111987 | 4/1990 | Japan . |
| 2-178664 | 7/1990 | Japan . |
| 2-117547 | 9/1990 | Japan . |
| 2-227299 | 9/1990 | Japan . |
| 3-249661 | 11/1991 | Japan . |
| 4-22968 | 1/1992 | Japan . |
| 4-57070 | 2/1992 | Japan . |
| 4-64472 | 2/1992 | Japan . |
| 4-64473 | 2/1992 | Japan . |
| 4-67043 | 3/1992 | Japan . |
| 4-82983 | 3/1992 | Japan . |
| 4-89271 | 3/1992 | Japan . |
| 4-91298 | 3/1992 | Japan . |
| 4-234056 | 8/1992 | Japan . |
| 4-118499 | 10/1992 | Japan . |
| 4-118500 | 10/1992 | Japan . |
| 4-281096 | 10/1992 | Japan . |
| 4-300395 | 10/1992 | Japan . |
| 4-327299 | 11/1992 | Japan . |
| 4-333088 | 11/1992 | Japan . |
| 4-333699 | 11/1992 | Japan . |
| 4-356085 | 12/1992 | Japan . |
| 4-356086 | 12/1992 | Japan . |
| 4-356087 | 12/1992 | Japan . |
| 4-356088 | 12/1992 | Japan . |
| 4-356089 | 12/1992 | Japan . |
| 5-2356 | 1/1993 | Japan . |
| 5-61382 | 3/1993 | Japan . |
| 5-127571 | 5/1993 | Japan . |
| 5-216374 | 8/1993 | Japan . |
| 5-216376 | 8/1993 | Japan . |
| 6-43682 | 2/1994 | Japan . |
| 6-67576 | 3/1994 | Japan . |
| 6-206358 | 7/1994 | Japan . |
| 6-208318 | 7/1994 | Japan . |
| WO8903728 | 5/1989 | WIPO . |

APPARATUS FOR REPETITIVELY USING A TONER IMAGE CARRIER

This is a division of application Ser. No. 08/118,117 filed Sep. 7, 1993 now abandoned.

BACKGROUND OF THE INVENTION

The present invention relates to a copier, facsimile machine, printer or similar image forming apparatus of the type forming a toner image on a sheet or similar toner image carrier. More particularly, the present invention is concerned with a method which allows the toner image carrier to be repetitively used without deforming it by removing only a toner from the carrier, and a toner applicable thereto.

A copier, for example, has been implemented by various image forming processes in the past, e.g., a diazo process and a silver halide process. Today, an electrophotographic copier capable of forming images on plain paper sheets, i.e., plain paper copier (PPC) is predominant over the others. In parallel with the remarkable growth of information-oriented society, technologies for producing a great amount of copies at high speed and producing high quality copies have been developed. Further, peripheral equipment are available which are easy to operate and can readily produce a great amount of copies. While such a situation allows many persons to share the same information through the copies, new informations are generated at all times, copied, and discarded. The result is the consumption of a huge amount of papers.

To prevent environmental disruption ascribable to lumbering, a current trend is toward the use of papers regenerated from used papers, instead of papers made from wood pulp. However, the problem with such regenerated sheets is that a large scale facility is needed to remove ink from the copies and other used papers. In the light of this, there has been developed toners having particular compositions which render dyes transparent when illuminated by near infrared rays (880 nm). With such toners, it is possible to use papers a number of times. Specifically, Japanese Patent Laid-Open Publication No. 100728/1976 discloses a method which removes an image from a copy by use of toluene, tetrachloroethylene or similar solvent. Japanese Patent Laid-Open Publication No. 137266/1989 teaches mixing an absorptive high molecule gel with a toner containing at least a binding resin and a coloring agent. The toner with the absorptive high molecule gel is expected to remove a toner fixed on an OHP (OverHead Projector) sheet or similar resinous film by a PPC, so that the film may be repetitively used.

However, the method using a toner having a particular composition as stated above is not practicable without resorting to a bulky device and great energy for the radiation of near infrared rays. Moreover, since stoners having particular compositions available at the present stage of development are only blue toners, they cannot provide images with sufficient contrast and are expensive.

SUMMARY OF THE INVENTION

It is, therefore, an object of the present invention to provide a method which allows a sheet or similar toner image carrier produced from an image forming apparatus to be repetitively used without deforming it by removing only a toner from the carrier, and a toner applicable thereto.

A method of repetitively using a toner image carrier on which a toner image is formed of the present invention comprises the steps of causing a toner to deposit on the toner image carrier in a low adhesion condition to form a toner image, and removing the toner from the toner image carrier to erase the toner image for thereby allowing the toner image carrier to be repetitively used.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
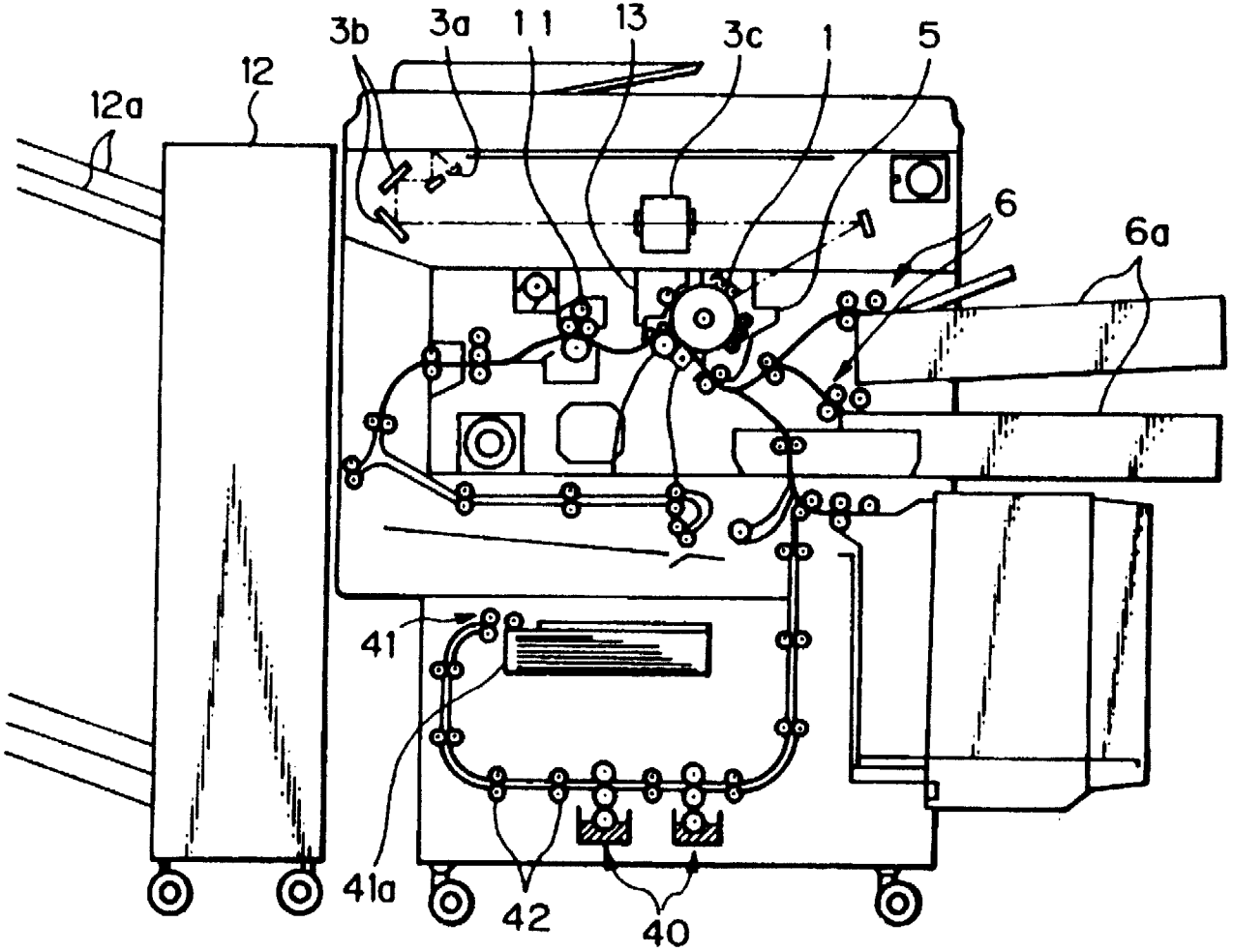
FIG. 1 is a section of a copier with which a method of the present invention is practicable.
Figure 2:
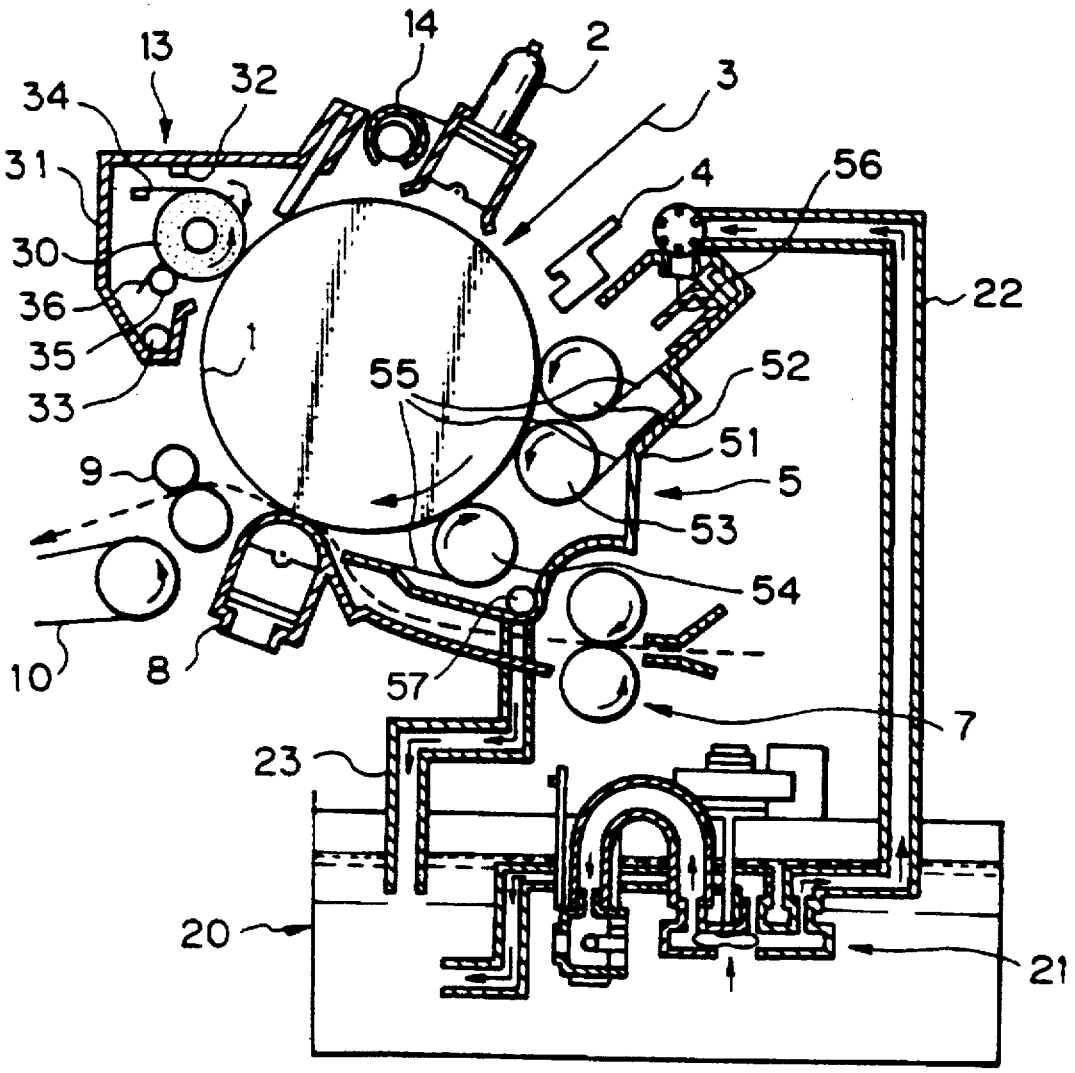
FIG. 2 is an fragmentary enlarged section of the copier.

Referring to FIGS. 1 and 2, an image forming apparatus with which a method of the present invention is practicable is shown and implemented as an electrophotographic copier using a liquid developer. As shown, the copier has an image carrier in the form of a photoconductive drum 1. During a copying operation, the drum 1 is rotated by a drive source, not shown, in a direction indicated by an arrow in the figure. A main charger 2 uniformly charges the surface of the drum 1 being rotated. As a lamp 3*a* illuminates a document, not shown, the resulting reflection from the document is focused onto the charged surface of the drum 1 as image 3, via a mirror 3*b*, a lens 3*c* and so forth which constitute an exposing device together with the lamp 3*a*. As a result, a latent image is electrostatically formed on the drum 1. An eraser 4 dissipates the charge of the drum 1 outside of the image forming area. A developing unit 5 develops the latent image with a liquid developer stored therein to form a corresponding toner image on the drum 1. A recording medium, e.g., a sheet is fed from a cassette 6*a* by a sheet feeding device 6 toward register roller 7. The register roller 7 drives the sheet toward the drum 1 at a predetermined timing. A transfer charger 8 transfers the toner image from the drum 1 to the sheet that has reached the drum 1. The sheet carrying the toner image thereon is separated from the drum 1 by a separation roller 9 and then transported to a fixing unit 11 via conveying belt 10 to have the toner image fixed thereon. Subsequently, the sheet is subjected to predetermined processing in a finisher 12 and then driven out to a tray 12*a*. After the image transfer, a cleaning unit 13 removes the toner remaining on the drum 1, and then a discharge lamp 14 dissipates the charge also remaining on the drum 1. This prepares the drum 1 for the next copying cycle.

The developing unit 5 has a casing 51 accommodating a first and a second developing roller 52 and 53 and a squeeze roller 54. The developing rollers 52 and 53 are spaced 0.1 mm to 0.2 mm from the drum 1, while the squeeze roller 54 is spaced 0.05 mm from the drum 1. The developing rollers 52 and 53 are each rotated in the opposite direction to the drum 1, as indicated by an arrow, and at a higher speed than the drum 1 by a drive source, not shown. Scrapers 55 are affixed to the casing 51 and respectively held in contact with the rollers 52, 53 and 54 to remove the toner therefrom. A nozzle 56 is disposed in an upper portion of the casing 51. A pump 21 supplies a liquid developer under pressure from a reservoir 20 to the nozzle 56 via a pipe 22. The developer introduced into the casing 51 via the nozzle 56 is stored between the developing rollers 52 and 53 and their associated scrapers 55. The developing rollers 52 and 53 in rotation convey the developer evenly to the surface of the drum 1. After developing the latent image on the drum 1, the developer is returned to the reservoir 20 for reuse via an opening 57 formed through the casing 51 and a pipe 23. Excessive part of the developer is removed from the drum 1 by the squeeze roller 54 and also collected in the reservoir 20 via the pipe 23. With this type of developing unit 5, it is possible to adjust the amount of developer to deposit on the drum 1 and move to an image transfer position by controlling, e.g., the gaps between the drum 1 and the rollers 52–54 or the peripheral speeds of the drums 52–54.

The cleaning unit 13 has a cleaning roller 30 contacting the drum 1 and implemented as, e.g., a foam roller. A casing 31 is formed with a liquid inlet 32 at the top and a liquid outlet 33 at the bottom. A feed pipe, not shown, is connected to the liquid inlet 32 to feed the developer, or cleaning liquid, from the reservoir 20 to the inlet 32. Another pipe, not shown, is connected to the liquid outlet 33 to return the developer from the casing 31 to the reservoir 20. A plate 34 is disposed below the liquid inlet 32 to distribute the developer over the entire length of the cleaning roller 30. A squeeze roller 35 is held in contact with the cleaning roller 30 to squeeze out the cleaning liquid containing the toner removed from the drum 1. A scraper 36 is positioned to contact the squeeze roller 35.

The copier described above is conventional except that it can remove a toner image from a sheet used as a data transfer medium so as to use the paper sheet repetitively. For this purpose, the developer stored in the reservoir 20 is improved. Further, the copier is provided with a toner removing device for removing the toner, i.e., toner image from the sheet which would otherwise be discarded. This will be described specifically hereinafter.

To begin with, Japanese Patent Laid-Open Publication No. 18572/1987, for example, discloses a liquid developer applicable to a copier and in which a binding resin is dispersed. The binding resin strongly adheres to the fibers of a sheet or a transfer material, allowing a toner image to be permanently fixed thereon. Particularly, when a thermosetting resin is contained in the toner, the toner is strongly fixed on the toner image carrier when heated. This kind of developer, therefore, would prevent the toner thereof from being easily removed from a paper sheet expected to be repetitively used. In accordance with the present invention, the developer is improved such that the adhering force of the toner is weak enough to allow the toner to be removed from a sheet. Of course, the developer consists of a liquid carrier and a toner as a conventional two-component type developer.

For the liquid carrier, use may be made of isodecane, n-hexane or commercially available Shellzole 71 (Shell Petroleum) or Isoper G, H, E, L, K, M or V (Ecson). Dimethylsiloxane (e.g. KF96L-0.65, KF96L-1.0 or KF96L-1.5 available from Shinetsu Chemicals), phenylmethylsilixane (e.g. KF58 available from Shinetsu Chemicals) and cyclic siloxane (e.g. KF994 available from Shinetsu Chemicals) are more preferable in respect of odor and environmental hygiene.

The toner contains a coloring agent and a binding resin as major components thereof and may additionally contain a dispersed resin and a charge controlling agent, as needed.

The coloring agent is implemented by an inorganic pigment, e.g., furnace black, acetylene black, channel black or similar carbon black, or commercially available Printex G, Printex V, Special Black 15, Special Black 4 or Special Black 4-B (available from Degsa), Mitsubishi #44, #30, MA-11 or MA-100 (available from Mitsubishi Carbon), Larben 30, Larben 40 or Conductex SC (available from Columbia Carbon), or Legal 400, 600 or 800 or Black Pearl (available from Cabot). Inorganic pigments including zinc oxide, titanium oxide and silicon oxide are other examples. Even organic pigments may be used which include Phthalocyanine Blue, Phthalocyanine Green, Rhodamine Lake, Malachite Green Lake, Methyl Violet Lake, Peacock Blue Lake, Natole Green B, Permanent Red 4R, Hansa Yellow, Benzidine Yellow, and Thioindigo red. Further, such an organic pigment and an inorganic pigment may be used in combination.

The binding agent is constituted by a polymer or a copolymer (resins including acrylester) having a repetitive unit expressed as:

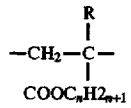

where R is representative of H or $CH_3$, and n is 1, 2, 3, 4, 5, 6, 7 or 8, preferably 1, 2, 3 or 4. Such a binding agent has a weaker binding force than conventional ones. Examples are polymethyl methacrylate, polybutyl methacrylate, polyisobutyl methacrylate, poly-2-ethylhexyl methacrylate, polymethyl acrylate, polybutyl acrylate, and poly-2-ethylhexyl acrylate.

A specific procedure for adjusting the developer is as follows. 0.3 to 3 parts by weight of binding resin is mixed with 1 part by weight of coloring agent. The resulting mixture is sufficiently dispersed under the presence of 10 to 20 parts by weight of the liquid carrier by an attriter, ball mill, pearl mill or similar mill to produce a condensed toner. The condensed toner is diluted by three times to 10 times by the liquid carrier, as needed. A dispersed resin, metallic soap, lecithin, linseed oil, higher fatty acid or similar polarity control agent may be added to the mixture of coloring agent and binding resin.

In the above-stated developer, the binding force of the toner is weaker than that of conventional ones due to the binding resin having the above particular structure. When the solvent is evaporated from the toner forming a toner image on a sheet (synthetic sheet) is evaporated, the toner image does not adhere to the sheet as fast as a toner image formed by a conventional toner.

Since the fixation of the toner having the above composition on a sheet is excessively weak, an adhesion control agent having a great n number, e.g., LMA (lauryl methacrylate) may be added to the toner to control the fixing or adhering ability.

Examples of the toner implemented by the binding resin are as follows.

EXAMPLE 1

80 parts by weight of plymethyl metacrylate, 300 parts by weight of Isoper H (Ecson) and 0.1 part by weight of lecithin were mixed with 100 parts by weight of carbon black (Mitsubishi #44 available from Mitsubishi Carbon). The resulting mixture was dispersed for 10 hours by attriter to produce a toner having a mean particle size of 0.8 micron.

EXAMPLE 2

80 parts by weight ef polymethyl metacrylate, 300 parts by weight of dimethylsiloxane (KF96L-1.0 available from Shinetsu Chemicals) and 0.1 part by weight of lecithin were mixed with 100 parts by weight of carbon black (Mitsubishi #44 available from Mitsuibishi Carbon). The resulting mixture was dispersed for 24 hours by a ball mill to produce a toner having a mean particle size of 1.3 microns.

EXAMPLE 3

Example 2 was repeated except that the binding resin was implemented by a polyehtyl metacrylate 2-ethylhexyl metacrylate copolymer (molar ratio of 50/50). The resulting toner was measured to have a mean particle size of 1.4 microns.

EXAMPLE 4

Example 2 was repeated except that the binding resin was implemented by polybutyl metacrylate. The resulting toner was measured to have a mean particle size of 1.3 microns.

EXAMPLE 5

Example 2 was repeated except that the binding resin was implemented by polyisobutyl metacrylate. The resulting toner was measured to have a mean particle size of 1.0 micron.

EXAMPLE 6

Example 2 was repeated except that the binding resin was implemented by poly-2-ethylhexyl metacrylate. The resulting toner was measured to have a mean particle size of 0.85 micron.

EXAMPLES 7–10

Example 1 was repeated except that the content of polymethyl acrylate was changed as shown in Table 1 below.

TABLE 1

| EXAMPLE | POLYMETHYL ACRYLATE | POLYLAURYL METACRYLATE | MEAN PARTICLE SIZE |
|---|---|---|---|
| Example 7 | 70 parts | 10 parts | 1.0 μm |
| Example 8 | 50 parts | 30 parts | 1.3 μm |
| Example 9 | 40 parts | 40 parts | 1.1 μm |
| Example 10 | 20 parts | 60 parts | 0.9 μm |

Comparative Example

Example 2 was repeated except that the binding agent was implemented by polylauryl metacrylate. The resulting toner was measured to have a mean particle size of 1.1 microns.

Hereinafter will be described a sheet suitable for repetitive use. The primary requisite with this kind of sheet is the elasticity high enough to withstand the repetitive use. Also, when an electric field for image transfer is formed between the sheet and a photoconductive element by a charger, the sheet has to maintain a predetermined resistance. Another requisite is that the sheet maintains such elasticity and resistance even when it is reused after the removal of the toner, as will be described later.

A sheet meeting above requisites may be implemented as a plastic sheet. Specifically, the major component of a plastic sheet may be polyester, polyimide, polysulfone, polyethersulfone, polyphenylene sulfide, polyether etherketone, or polycarbonate. Among them, polyester is desirable in respect of characteristics and cost. A sheet implemented by polyester will be referred to as a polyester sheet hereinafter. A polyester sheet, for example, contains a copolymerized polyester constituting polyethylene terephthalate and ethylene terephthalate as a major component thereof. Regarding the copier of the type concerned, use is made of a polyester sheet which is 50 microns to 200 microns thick, preferably 75 microns to 150 microns thick.

To eliminate double feed and other defective sheet feed, the sheet should prefer. ably have a porous surface. This is especially true with the copier having a toner removing device which deposits a liquid on the sheet, as will be described later. Specifically, a sheet having a porous surface holds a liquid in the pores thereof. This prevents the liquid intervening between the projections of nearby sheets (portions other than the pores) or between the projections of the sheet and transport rollers or similar guides from playing the role of an adhesive and aggravating the resistance to sheet transport. Synthetic sheets in general, e.g., Peach Coat (trade name) available from Nisshin Industries and YUPO (trade name) available from Oji Yuka Synthetic Paper have such a porous surface and are especially feasible for the present invention.

Synthetic sheets and other resinous sheets are stronger than plain papers and crease little even when a liquid for removing the toner is deposited thereon, as will be described later. Further, synthetic sheets are feasible for recycling and can be sufficiently charged even when some liquid for removing the toner, e.g., water is deposited thereon. For example, papers made of wood pulp (whose surfaces are not coated with resin) reach saturation at 200 volts to 300 volts, while synthetic sheets coated with volatile resin can be charged to above 1000 volts. The sheet is acceptable if it has a specific surface resistance higher than ×108 Ω.cm; it should preferably have a porous surface. However, the surface of the sheet should preferably be flat to promote toner removal which will be described. When such a sheet having a flat surface is used, it is preferable to evaporate the liquid by heat or a stream of air in the event of recycling so as to reduce double feed and other defective sheet feed. If desired, a layer having low surface energy may be formed on the surface of a synthetic sheet to control the adhesion of the toner thereon.

Specific sheets desirably applicable to the present invention are as follows.

EXAMPLE 1

Polyethylene-based sheet: WG-140 (135 microns), WG-170 (160 microns) and WGR-170 (157 microns) available from Nisshin Industries

EXAMPLE 2

Polyethylene-based sheet: WE-110 (110 microns), WEK-110 (110 microns), SE80 (65 microns) and SEK-80 (80 microns) available from Nisshin Industries

EXAMPLE 3

Polypropyrene-based sheet: SP-80 (80 microns), SPB-80 (80 microns), WP-110 (110 microns) and SPG-70 (62 microns) available from Nisshin Industries; VIF#70 (70 microns), #90 (90 microns), #140 (140 microns), VIS#90 (90 microns), VIS#120 (120 microns), VOF#120 (120 microns), VNF 190 (187 microns) and BP Coat 110 (103 microns) available from Oji Yuka Synthetic Paper

EXAMPLE 4

Sheet produced by forming a 2 microns to 10 microns thick silicone coating on the surface of the synthetic paper of any one of Examples 1–3 by a wire bar method or a spray coating method.

Figure 3:
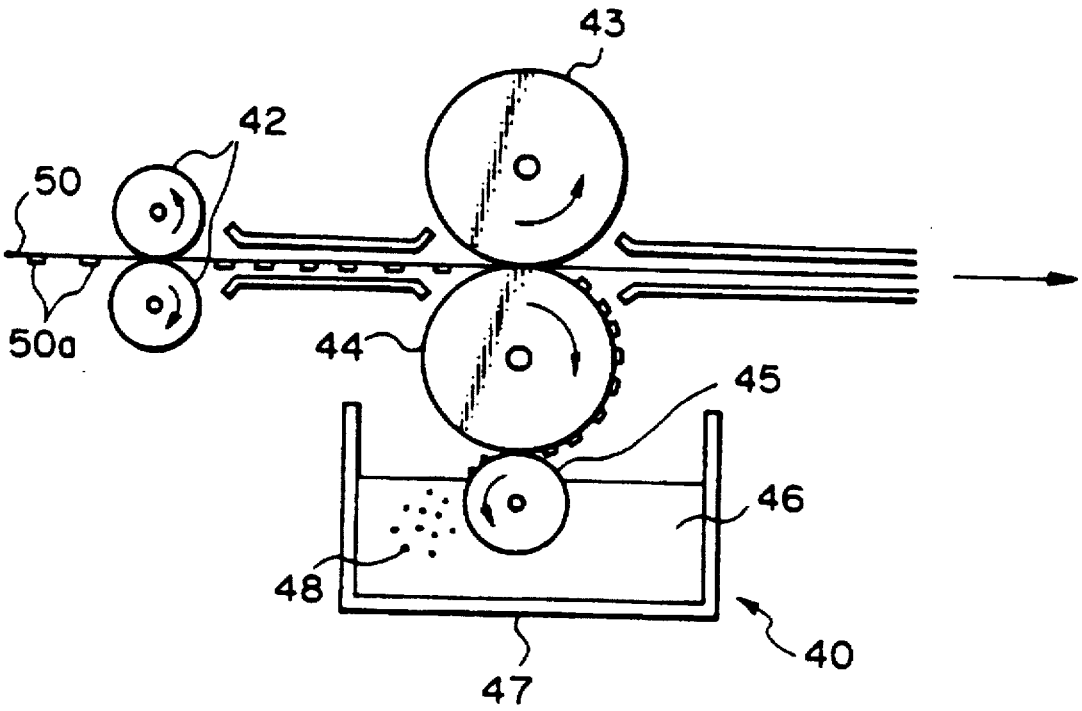
FIG. 3 is a section of a toner removing device included in the copier.

Referring to FIG. 3, the device for removing the toner constituting a toner image on a sheet will be described. As shown, the device, generally 40, has a transport roller pair 42 to which a sheet 50 carrying a toner 50*a* thereon is fed from the left-hand side, as viewed in the figure. The transport roller pair 42 drives the sheet to a press roller 43 and a squeeze roller 44 which cooperate to remove the toner 50*a*, i.e., erase a toner image formed by the toner 50*a*. The squeeze roller 44 is rotated at a higher peripheral speed than the transport roller pair 42. A liquid supply roller 45 is disposed below and held in contact with the squeeze roller 44. This roller 45 is partly immersed in a liquid, e.g., water 46 stored in a liquid reservoir 47. As the liquid supply roller 45 is rotated by the squeeze roller 44, the former supplies the liquid 46 to the latter. As a result, the liquid forms a film on the squeeze roller 44. The squeeze roller 44 with such a film rubs off the toner 50*a* fixed on the sheet 50. The toner 50*a* removed from the sheet 50 is conveyed by the squeeze roller 44 to the liquid supply roller 45. Then, the toner is trapped by the liquid film present on the liquid supply roller 45. Consequently, the toner is dispersed in the liquid 46, as indicated by the reference numeral 48. The press roller 43 rests on the squeeze roller 44 due to gravity. While the sheet 50 is not transported, the press roller 43 is rotated by the squeeze roller 44 at a higher peripheral speed than the transport roller pair 42. While the sheet 50 is in transport, the press roller 43 is driven by the sheet 50. The liquid supply roller 45 is also rotated by the squeeze roller 44.

Experiments showed that water is most desirable as the liquid for removing the toner 50*a* from the sheet 50. Even when the toner 50*a* removed from the sheet 50 was again introduced into the water supplied by the supply roller 45 and deposited on the squeeze roller 44, it did not deposit on the sheet 50 again at all; otherwise, it would contaminate the background of the sheet 50. This is presumably because water has a relatively low resistance and, even if the toner removed from the sheet 50 has been charged, electrically neutralizes it by discharging it at once, thereby preventing the toner from electrostatically depositing on the constituent parts of the device. It is to be noted that a liquid other than water may be used so long as it has a resistance lower than $1\times10^8$ Ω.cm. To allow the liquid to maintain such a toner discharging function for a long time, it is preferable to implement at least the inner periphery of the liquid reservoir 47 by a conductive material and connect it to ground or to connect the squeeze roller 44 and other members contacting the liquid to ground.

If the liquid reservoir 47 is made of conductive resin or plated metal, it will prevent the removed toner from depositing on the walls thereof and will be protected from rust despite aging. The squeeze roller 44 may advantageously be made of solid rubber or foam material in respect of the removal of the toner image. Should the squeeze roller 44 be made of an excessively soft material, the nip width thereof would be increased to adversely effect the sheet transport and, moreover, would bring about permanent compression set and other defects. In the light of this, the roller 44 should preferably be provided with a hardness of greater than 20 degrees. As for the foam material, a foam density of 0.2 g/cm$^3$ is desirable.

Another reservoir may be disposed inside or outside of the liquid reservoir 47 so as to circulate the liquid therebetween. In such a case, it is preferable to locate a filter at a suitable position on a circulation path to collect the removed toner. Then, the liquid purified by the filter will be fed to the liquid supply roller 45 and, therefore, prevented from depositing on the sheet again. The filter should preferably be provided with a mesh size of #100 to #300; short mesh sizes would cause the toner to stop up the filter while excessive mesh sizes would allow it to pass therethrough.

Preferably, the press roller 43 and liquid supply roller 45 are made of resin or stainless steel since they deal with water. It is preferable to form circumferential grooves on the rollers 43 and 45, so that water may be efficiently scooped up. It was found by experiments that such grooves enhance the ability to supply water to the squeeze roller 44 and promote smooth removal of water from the press roller 43.

As shown in FIG. 1, two toner removing devices 40 each having the above-described construction are arranged in a console. Also accommodated in the console are a cassette 41*a* loaded only with sheets to be repetitively used, a pick-up roller 41 for feeding the sheets from the cassette 41*a*, a transport roller 42 for transporting the sheet fed by the pick-up roller 41 to the toner removing devices 40, and an arrangement for transporting the sheet from the toner removing devices 40 to the register roller 7, FIG. 2.

In operation, the copies 50 used and needless are stacked on the exclusive cassette 41*a* to be recycled. To produce copies which should be permanently preserved, the sheets stored in the ordinary cassettes 6*a* are used. A mode select switch is provided on an operation panel, not shown, and operated to select one of the cassettes 6*a* and 41*a*. Assume that a mode for feeding the sheets or copies 50 from the cassette 41*a* is selected. Then, as a print switch is pressed, the pick-up roller 41 feeds the sheet 50 out of the cassette 41*a*. The sheet 50 is transported to the toner removing devices 40 to have the toner image thereof removed. Subsequently, the sheet 50 is conveyed to the photoconductive drum 1 via the register roller 7. As a result, a toner image formed on the drum 1 is transferred to the recycled sheet 50 in the same manner as in the ordinary copy mode. After the toner image has been fixed on the sheet 50 by the fixing unit 11, the sheet 50 is driven out to the tray 12*a* via the finisher 12. Therefore, the sheet 50 can again serve as a data transfer medium for conference or similar purpose. This recycled sheet or copy 50 may be again stacked on the exclusive cassette 41*a* after it has been used.

A series of experiments were conducted by using the toners of Examples 1–6 relating to the toner, the sheets of Examples 1–4 relating to the sheet, and a copier CT-5085 (trade name) available from Ricoh and operable with a liquid developer. The toners on the sheets were removed by the toner removing device 40 shown in FIG. 3. The resulting conditions of the sheets were evaluated, as shown in Table 2 below. It is to be noted that Table 2 lists the result of evaluation associated with some of the sheets of Examples 1–4.

TABLE 2

| TONER | SHEET | EVALUATION |
|---|---|---|
| Example 1 | WG-140 | rank 5 |
| Example 2 | WG-140 | rank 5 |
| Example 3 | WG-140 | rank 5 |
| Example 4 | WG-140 | rank 5 |
| Example 5 | WG-140 | rank 5 |
| Example 6 | WG-140 | rank 5 |
| Example 7 | WG-140 | rank 5 |
| Example 8 | WG-140 | rank 5 |
| Example 9 | WG-140 | rank 4 |
| Example 10 | WG-140 | rank 3 |
| Example 7 | WG-140 with | rank 5 |

TABLE 2-continued

| TONER | SHEET | EVALUATION |
|---|---|---|
| | SYL-OFF7μ | |
| Example 8 | WG-140 with SYL-OFF7μ | rank 5 |
| Example 9 | WG-140 with SYL-OFF7μ | rank 5 |
| Example 10 | WG-140 with SYL-OFF7μ | rank 5 |
| Comp Example | WG-140 | rank 1 |
| Comp Example | WG-140 with SYL-OFF7μ | rank 4 |

In Table 2, rank 5 is representative of a condition wherein a toner is fully removed from a sheet. Rank 4 is representative of a condition wherein a toner is removed from a sheet although slightly left due to the undulation of the sheet surface (not noticeable as characters); such a sheet is acceptable in respect of recycling. Rank 3 shows a condition wherein some toner is left on the edges of characters on a sheet although the toner is mostly removed from the sheet. Rank 2 is representative of a condition wherein a toner is mostly left on a sheet, but characters are shaved and blurred. Further, rank 1 is representative of a condition wherein a toner is left on a sheet, and characters are shaved little.

Even with the sheets other than the sheets listed in Table 2, it was found that the toner removing device 40 successfully removes the toners. The recycled sheets (synthetic sheets) withstood 1,000 times of repetitive use.

When the previously mentioned LMA, for example, is mixed as an adhesion control agent, it should preferably be introduced such that the ratio of resin to pigment in weight (R/P ratio) is greater than 5/5 with respect to the pigment. This was also indicated by the above-stated result of evaluation.

The removal of toner by the toner removing device 40 depends on the binding component of the toner and the amount thereof and the composition and amount of the adhesion control agent, as well as on the sheet to be used, particularly the smoothness of the surface thereof. This will be seen from the comparative examples also included in Table 2. Further, the removal of toner was found to depend on the conditions for fixing the toner image. For example, when the toner image is fixed by heat, the removal of toner is effected by the fixing temperature and fixing time. Therefore, it is important to adjust the toner, sheet and fixing conditions such that the toner is sufficiently removed to allow the sheet to with stand repetitive use.

In summary, in accordance with the present invention, only a toner forming a toner image is removed from a copy or similar toner image carrier produced by a copier so as to erase the image. This allows the toner image carrier to be repetitively used without being deformed. This saves wood pulp which is a limited resource for forming toner image carriers and, therefore, contributes a great deal to the prevention of environmental disruption ascribable to lumbering.

What is claimed is:

1. An apparatus for removing images on an image carrier sheet to allow the image carrier sheet to be repeatedly used, said apparatus comprising:

an image removing member for removing images from an image carrier sheet, said images being fixed on the image carrier sheet;

a liquid supply for supplying a liquid to said image removing member;

a transporting mechanism for transporting the image carrier sheet with said fixed images to said image removing member, whereby said fixed images on the image carrier sheet are removed by said image removing member when said liquid supplied to said image removing member is applied to a surface of the image carrier sheet; and a pressing member for pressing said surface of the image carrier sheet against said image removing member, wherein said image removing member comprises a squeeze roller, said liquid supply means comprises a liquid supply roller, and said transporting mechanism comprises a pair of transport rollers, and wherein said squeeze roller is rotated at a higher speed than said pair of transport rollers.

2. An apparatus for removing images on a surface of an image carrier sheet, comprising:

an image removing member having a surface for removing images from the image carrier sheet;

a liquid supply for supplying a liquid to said image removing member;

a transporting mechanism for transporting the image carrier sheet to said image removing member;

a pressing member having a pressing surface opposing the surface of said image removing member, with the intermediary of said image carrier sheet, for pressing the surface of said image carrier sheet against the surface of said image removing member; and a moving mechanism for moving said image removing member at a different speed from that of said image carrier sheet transported by said transporting mechanism, wherein said image removing member comprises a squeeze roller, said transporting mechanism comprises a pair of transport rollers, and said pressing member comprises a press roller and wherein said squeeze roller is rotated at a higher speed than said pair of transport rollers.

3. An apparatus for removing images on a surface of an image carrier sheet, comprising;

an image removing member having a surface for removing images from the image carrier sheet;

a liquid supply roller for supplying a liquid to said image removing member;

a transporting mechanism for transporting the image carrier sheet to said image removing member; and a moving mechanism for moving said image removing member at a different speed from that of said image carrier sheet transported by said transporting mechanism, wherein said image removing member comprises a squeeze roller, and said transporting mechanism comprises a pair of transport rollers and wherein said squeeze roller is rotated at a higher speed than said pair of transport rollers.

* * * * *